US008671606B2

(12) United States Patent
Plataniotis et al.

(10) Patent No.: US 8,671,606 B2
(45) Date of Patent: Mar. 18, 2014

(54) AMMUNITION MAGAZINE

(76) Inventors: Nicholas Anthony Plataniotis, Florence, KY (US); Richard Clinton Truman, Springfield, OH (US)

( * ) Notice: Subject to any disclaimer, the term of this patent is extended or adjusted under 35 U.S.C. 154(b) by 0 days.

(21) Appl. No.: 13/551,701

(22) Filed: Jul. 18, 2012

(65) Prior Publication Data

US 2013/0019511 A1 Jan. 24, 2013

Related U.S. Application Data

(60) Provisional application No. 61/508,993, filed on Jul. 18, 2011.

(51) Int. Cl.
*F41A 9/61* (2006.01)

(52) U.S. Cl.
USPC ..... 42/6; 42/7; 42/49.01; 42/49.02

(58) Field of Classification Search
USPC ..... 42/6, 7, 49.01, 49.02; 89/33.01, 33.1
See application file for complete search history.

(56) References Cited

U.S. PATENT DOCUMENTS

| | | | | | |
|---|---|---|---|---|---|
| 694,969 | A | * | 3/1902 | Kemp | 42/59 |
| 2,320,450 | A | | 6/1943 | Valenzuela | |
| 2,507,364 | A | * | 5/1950 | Benson | 42/50 |
| D230,348 | S | | 2/1974 | Sabel et al. | |
| 4,139,958 | A | * | 2/1979 | Foote | 42/49.02 |
| 4,484,403 | A | * | 11/1984 | Schwaller | 42/50 |
| 4,798,018 | A | * | 1/1989 | Johansson | 42/7 |
| 5,052,140 | A | * | 10/1991 | Smith | 42/7 |
| D327,642 | S | | 7/1992 | Foubister | |
| 5,159,136 | A | * | 10/1992 | Marsh | 42/71.01 |
| 5,166,459 | A | * | 11/1992 | Stahle | 42/71.02 |
| 5,437,118 | A | * | 8/1995 | Sniezak et al. | 42/7 |
| 5,566,487 | A | * | 10/1996 | Vaid et al. | 42/7 |
| 5,621,995 | A | * | 4/1997 | Smith | 42/7 |
| 5,630,535 | A | * | 5/1997 | Valenti | 224/271 |
| 6,547,415 | B1 | * | 4/2003 | Matthews | 362/191 |
| D474,762 | S | | 5/2003 | Moberg et al. | |
| 6,874,266 | B1 | * | 4/2005 | Kong | 42/71.01 |
| 6,952,895 | B1 | * | 10/2005 | Zonshine | 42/70.02 |
| 7,200,963 | B1 | * | 4/2007 | Vieweg | 42/49.01 |
| 7,237,354 | B1 | * | 7/2007 | Conner | 42/50 |
| 7,637,049 | B1 | * | 12/2009 | Samson et al. | 42/108 |
| 2004/0200111 | A1 | * | 10/2004 | Horn | 42/50 |
| 2004/0255504 | A1 | * | 12/2004 | Fitzpatrick | 42/49.01 |
| 2010/0154269 | A1 | * | 6/2010 | Escalante, III | 42/49.01 |
| 2011/0107645 | A1 | * | 5/2011 | Faifer | 42/90 |
| 2012/0091173 | A1 | * | 4/2012 | Crye | 224/196 |
| 2012/0311911 | A1 | * | 12/2012 | Nelson | 42/90 |

* cited by examiner

*Primary Examiner* — Bret Hayes
*Assistant Examiner* — Derrick Morgan
(74) *Attorney, Agent, or Firm* — Wood, Herron & Evans, L.L.P.

(57) ABSTRACT

A firearm includes a barrel having first and second ends, and is adapted to fire a round of ammunition from the second end. A handgrip is operatively coupled to and extending in a downward direction relative to the barrel. An ammunition magazine is removably received within the handgrip. The magazine includes a front, a rear, and a pair of opposed side surfaces extending between the front and rear. A clip member includes at least an arm portion extending along the rear of the magazine. The arm portion of the clip member is adapted to allow the ammunition magazine to be temporarily attached to an object while outside of the magazine.

13 Claims, 3 Drawing Sheets

AMMUNITION MAGAZINE

CROSS-REFERENCE TO RELATED APPLICATION

This application claims the priority of U.S. Provisional Patent Application Ser. No. 61/508,993, filed on Jul. 18, 2011 , the disclosure of which is incorporated by reference herein.

TECHNICAL FIELD

The invention generally relates to ammunition magazines for firearms and, more particularly, ammunition magazines for semi-automatic pistols and manners of carrying such magazines while they are separated from the firearm.

BACKGROUND

Ammunition magazines, for use with automatic or semi-automatic weapons such as pistols, are generally made in the form of elongate tubes or containers for holding the ammunition in a stacked condition. The magazine is inserted into the opening of a cavity or chamber in the firearm by pushing the magazine upwardly through the opening and locking it into place. The bottom surface of the magazine, at least in the case of a pistol, becomes the bottom surface of the pistol grip.

The user of an automatic or semi-automatic weapon often finds it necessary or desirable to find a way to carry one or more spare ammunition magazines. Various manners have been used in the past for accomplishing this task, including the use of special apparel with pockets, belts or holsters, or other means. Magazines with integrated clips have also been proposed but have various drawbacks limiting their usefulness.

For these and other reasons, there is a need for improvements in the area of ammunition magazines having clip members for easily carrying one or more magazines on the user, or on an item carried by the user, or even on another object such as for longer term storage.

SUMMARY

The invention, in one illustrative embodiment, generally comprises a firearm including a barrel having first and second ends, and adapted to fire a round of ammunition from the second end. A handgrip is operatively coupled to and extends in a downward direction relative to the barrel. An ammunition magazine is removably received within a cavity of the handgrip by inserting the magazine into an opening at a lower end of the cavity. The magazine includes a front, a rear, and a pair of opposed side surfaces extending between the front and rear. A clip member includes at least an arm extending along the rear of the magazine, and the arm of the clip member is adapted to allow the ammunition magazine to be temporarily attached to an object while the magazine is outside of the cavity. The object may, for example, be a pocket in a piece of apparel worn by the user, or may be any other suitable object such as a belt or other item worn by or carried by a user of the firearm. In other situations, such as for longer term storage, the object might not be associated directly with the user.

In other embodiments, the clip member may be attached along another surface of the magazine and is at least substantially fully concealed within the cavity of the handgrip when the magazine is fully inserted during use.

The firearm may take any of various forms, but the preferred form is a handgun, such as but not limited to a 9mm semi-automatic handgun. The magazine is received fully in the cavity of the handgrip such that the arm of the clip member is at least substantially fully concealed within the handgrip. This maintains the aesthetics of the firearm, ensures that the clip member does not interfere with handling of the weapon, and helps prevent damage to the clip member. In one illustrative form, the clip member further comprises a spring clip, which may be made of metal, such as by being stamped from a metal plate. The magazine further includes a bottom, and the spring clip is formed with a base plate configured to be secured to the bottom of the magazine and with the arm adapted to extend upwardly along the rear of the magazine and along a corresponding rear, interior surface of the cavity when the magazine is inserted into the handgrip.

In other embodiments, the invention comprises an ammunition magazine as described herein, and a method of using a firearm as described herein. Generally, the method includes: temporarily securing the magazine outside of the firearm by clipping the magazine to an object by securing the object between the clip member and the magazine, unclipping the magazine from the object, and inserting the magazine into a cavity of the handgrip such that the arm is at least substantially fully concealed within the handgrip.

Various additional advantages and features will become more readily apparent to those of ordinary skill in the art upon review of the following detailed description of the illustrative embodiments taken in conjunction with the accompanying drawings.

DETAILED DESCRIPTION

Figure 1:
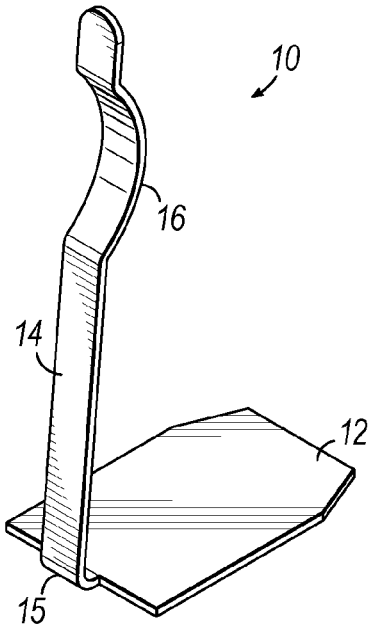
FIG. 1 is a perspective view of a clip member constructed in accordance with an illustrative embodiment of the invention.
Figure 2:
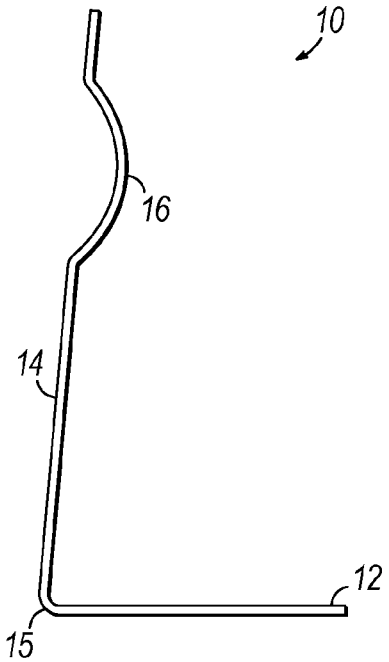
FIG. 2 is a side elevation view of the clip member shown in FIG. 1.

FIGS. 1 and 2 illustrate a clip member 10 constructed in accordance with an illustrative and non-limiting embodiment of the invention. This clip member 10 includes a base plate 12 and an arm 14 extending from the base plate 12. The arm 14 provides a spring clip mechanism as will be further described below. The arm may, for example, be about 2 1/2" in length. The clip member 10, in this embodiment, may be easily formed by a metal stamping operation in which the entire integral plate structure of the clip member 10 is first stamped in a flat condition, and then the angle 15 of the clip member 10 and the curved bend 16 are then formed by additional forming machinery.

The clip member 10 is preferably formed from a metal, such as a spring-type metal, e.g., stainless steel.

Figure 3:
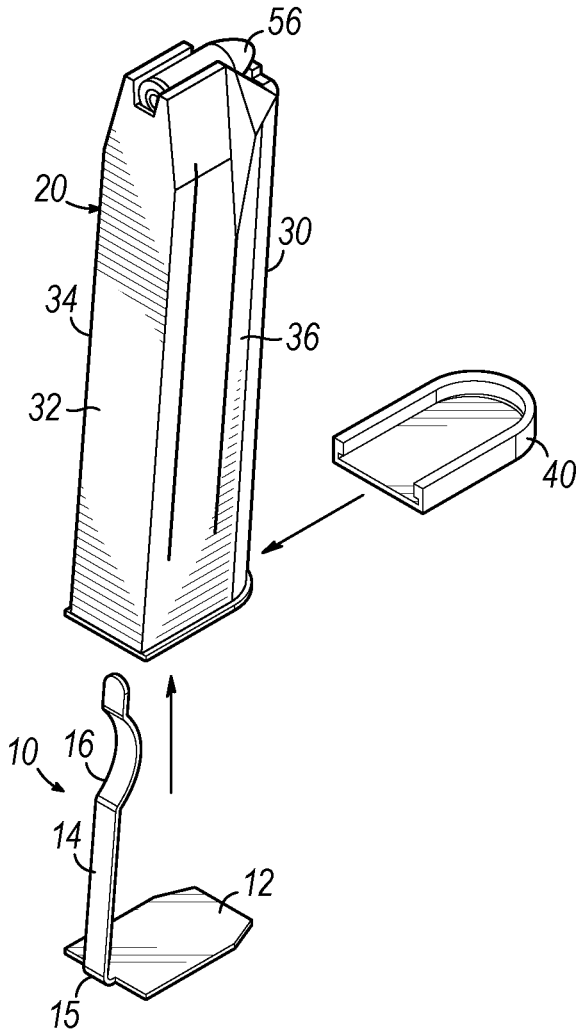
FIG. 3 is a disassembled perspective view of a pistol ammunition magazine being assembled with the clip member of FIG. 1.
Figure 4:
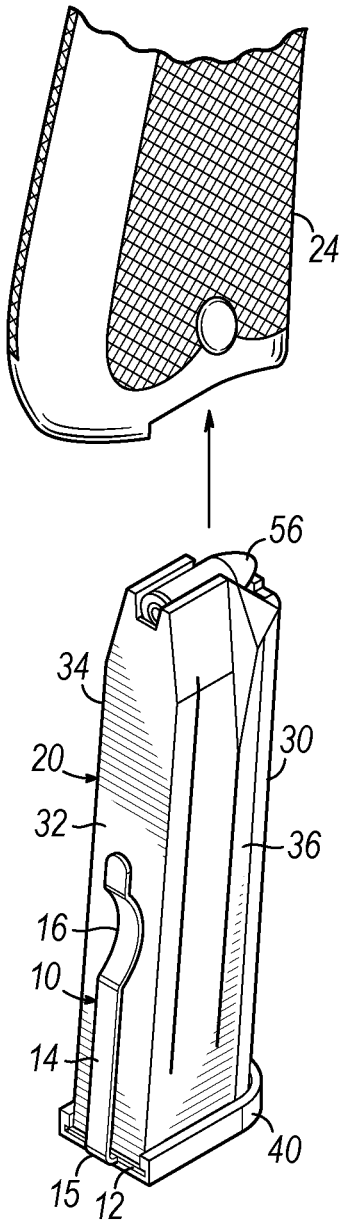
FIG. 4 is a disassembled perspective view of the assembled pistol ammunition magazine of FIG. 3 being assembled with a pistol grip.
Figure 5:
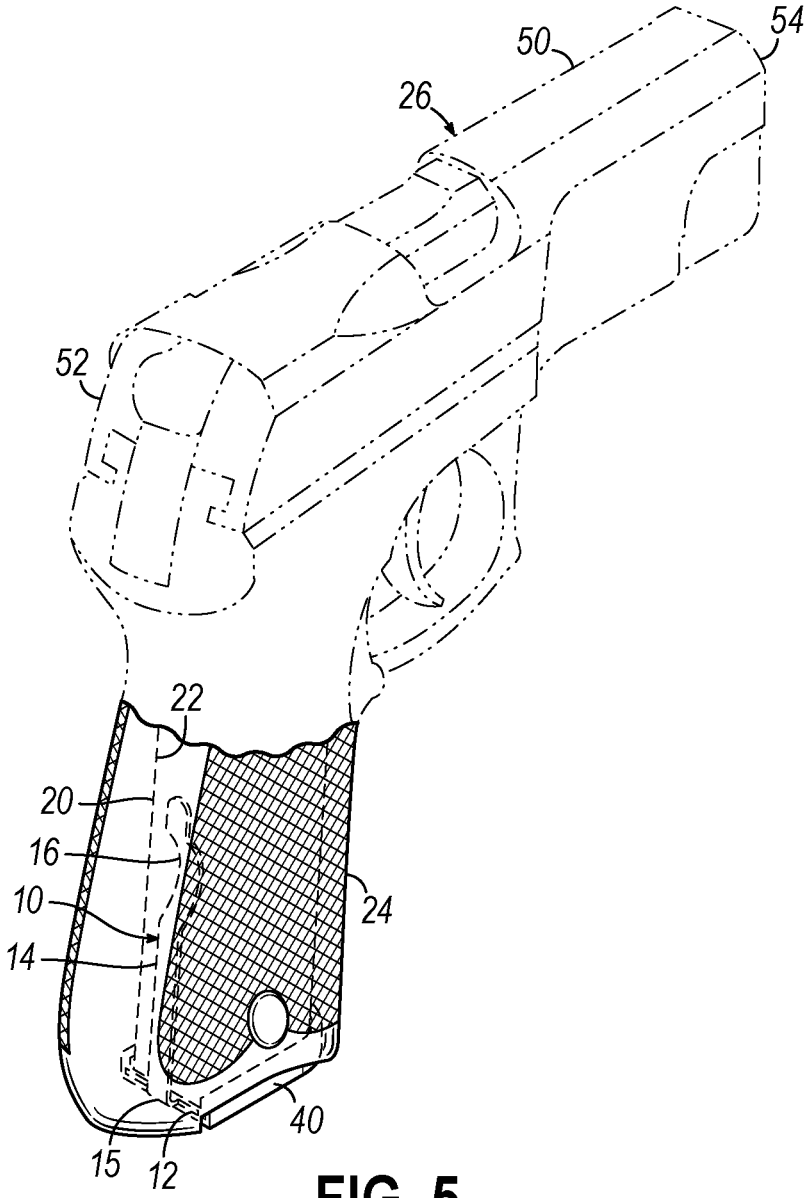
FIG. 5 is a perspective view of a pistol, shown partially in dash-dot lines for illustrative purposes only, assembled with the magazine of FIG. 4.

As further shown in FIGS. 3 and 4, the clip member 10 is assembled and secured to an ammunition magazine 20 which, in turn, is removably received within the cavity 22 (FIG. 5) of a handgrip 24 associated with a semi-automatic pistol 26 (FIG. 5). While a 9mm semi-automatic pistol 26, such as a Glock® brand pistol, is shown in the drawings, it will be understood that the embodiments of the present invention may be used with any firearm that utilizes an ammunition magazine, such as semi-automatic or automatic weapons of other types as well. The ammunition magazine 20 includes a front 30, a rear 32, and a pair of opposite surfaces 34, 36 extending between the front 30 and rear 32. The ammunition magazine 20 further includes a suitable cap or end plate 40 defining a bottom surface of the magazine 20 and which secures the base plate 12 of the clip member 10 to the magazine 20 as shown in FIGS. 3 and 4. It will be understood that other securing methods may be used instead, or the clip arm 14 may be more directly secured or manufactured as part of the magazine 20. The base plate 12 may include a hole (not shown) for location purposes if desired.

Referring now to FIGS. 3, 4 and 5, the magazine 20 is received fully in the cavity 22 of the handgrip 24, such as the pistol grip of a 9mm semi\- automatic pistol 26, such that the arm 14 of the clip member 10 is at least substantially fully concealed within the handgrip 24 (FIG. 5). Therefore, when the firearm 26 is in use, with the magazine 20 inserted as shown in FIG. 5, the clip member 10 is concealed for aesthetic value, and is not in a position to interfere with handling of the firearm 26, or in a position to be damaged during handling of the firearm 26. As further shown in FIG. 5, the firearm 26 generally includes a barrel 50 having first and second ends 52, 54 and is adapted to fire a round ammunition 56 (FIG. 4) from the magazine 20 out through the second end 54. In the case of a pistol 26, as shown, the handgrip 24 is coupled to the first end 52 of the barrel 50 such that the rounds of ammunition 56 (FIG. 4) are capable of being positioned and deposited into the first end 52 of the barrel 50 during firing of the weapon.

Figure 6:
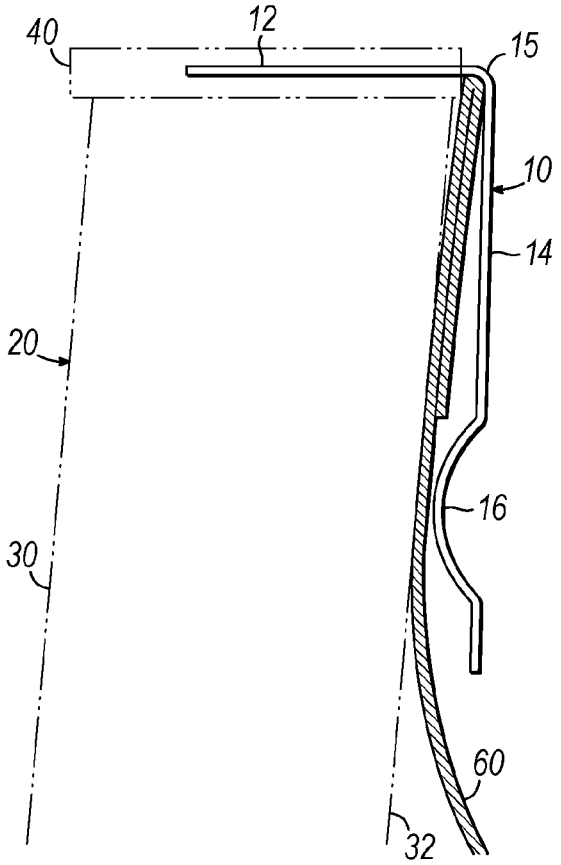
FIG. 6 is a side elevation view of the clip member of FIG. 1, shown in dash-dot lines, and temporarily attaching the magazine to an object such as a piece of fabric which forms a pocket in an item of apparel.

FIG. 6 is a schematic view and representation of one manner of using the clip member 10 while the magazine 20 is separated from the firearm 26, such as during storage or carrying of one or more spare magazines 20 by the user. This figure illustrates the magazine 20 clipped to a piece of fabric 60 which may, for example, define a pocket in an item of apparel of the user. The magazine 20 is easily clipped in place by inserting the fabric 60 between the spring clip arm 14 and the rear 32 of magazine 20 such that the curved 16 tightly engages the fabric 60 against the rear 32 of the magazine 20.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept. What is claimed is:

What is claimed is:

1. A firearm, comprising:

a barrel having first and second ends, and adapted to fire a round of ammunition from the second end, a handgrip operatively coupled to and extending in a downward direction relative to the barrel, the handgrip including a cavity with a lower end defining an opening, an ammunition magazine removably received within the cavity of the handgrip by insertion of the magazine through the opening, the magazine having a front surface facing in the same direction as the second end of the barrel when the magazine is received within the cavity of the handgrip, a rear surface facing in an opposite direction relative to the front surface, and a pair of opposed side surfaces extending between the front and rear surfaces, a clip member attached to the magazine and having at least an arm extending along the rear surface of the magazine, the arm of the clip member adapted to allow the ammunition magazine to be temporarily attached to an object while the magazine is outside of the cavity, and wherein the magazine is received fully in the cavity of the handgrip such that the arm of the clip member is at least substantially fully concealed within the handgrip.

2. The firearm of claim 1, wherein the firearm further comprises a handgun.

3. The firearm of claim 2, wherein the handgun further comprises a 9mm handgun.

4. The firearm of claim 1, wherein the clip member further comprises a spring clip.

5. The firearm of claim 1, wherein the spring clip is formed from metal.

6. The firearm of claim 1, wherein the magazine further includes a bottom, and the spring clip is formed from a metallic plate having a base plate secured to the bottom of the magazine and the arm extending upwardly along a rear interior surface of the cavity.

7. An ammunition magazine adapted to be removably received within a handgrip of a firearm, the firearm including a barrel having first and second ends, and adapted to fire a round of ammunition from the second end, and the handgrip operatively coupled to and extending in a downward direction relative to the barrel, the handgrip further including a cavity with a lower end defining an opening, and the magazine comprising:

a front surface facing in the same direction as the second end of the barrel when the magazine is received within the cavity of the handgrip, a rear surface facing in an opposite direction relative to the front surface, and a pair of opposed side surfaces extending between the front and rear surfaces, a clip member having at least an arm extending along the rear surface of the magazine, the arm adapted to allow the ammunition magazine to be temporarily attached to an object while outside of a cavity of the handgrip, and wherein the magazine is configured to be received fully in the cavity of the handgrip such that the arm is at least substantially fully concealed within the handgrip.

8. The ammunition magazine of claim 7, wherein the magazine further comprises a handgun magazine.

9. The ammunition magazine of claim 8, wherein the magazine further comprises a 9 mm handgun magazine.

10. The magazine of claim 7, wherein the clip member further comprises a spring clip.

11. The magazine of claim 7, wherein the spring clip is formed from metal.

12. The magazine of claim 7, wherein the magazine further includes a bottom, and the spring clip is formed from a metallic plate having a base plate secured to the bottom of the magazine with the arm extending upwardly along the rear surface of the magazine.

13. A method of using a firearm, wherein the firearm comprises a barrel having first and second ends, and adapted to fire a round of ammunition from the second end, a handgrip operatively coupled to and extending in a downward direction relative to the barrel, the handgrip including a cavity having a lower end defining an opening and further having a rear interior surface facing in the same direction as the second end of the barrel, an ammunition magazine removably received within the cavity, and a clip member having at least an arm extending along a rear surface of the magazine, the rear surface of the magazine facing in an opposite direction relative to the second end of the barrel when the magazine is received within the cavity, the method comprising:

temporarily securing the magazine outside of the firearm by clipping the magazine to an object by securing the object between the clip member and the magazine, unclipping the magazine from the object, inserting the magazine through the opening and into the cavity of the handgrip such that the arm extends into the cavity and along the rear interior surface of the cavity, and wherein inserting the magazine further comprises:

at least substantially fully concealing the arm within the handgrip.

* * * * *